United States Patent [19]

Wittmann et al.

[11] Patent Number: 4,993,742

[45] Date of Patent: Feb. 19, 1991

[54] SKI BINDING FOR A CROSS-COUNTRY OR TOURING SKI

[75] Inventors: Heinz Wittmann, Vienna; Roland Erdei, Pottendorf; Klaus Holzl, Vienna, all of Austria

[73] Assignee: TMC Corporation, Baar/Zug, Switzerland

[21] Appl. No.: 254,942

[22] PCT Filed: Nov. 15, 1986

[86] PCT No.: PCT/EP86/00659

§ 371 Date: Sep. 22, 1988

§ 102(e) Date: Sep. 22, 1988

[87] PCT Pub. No.: WO87/03211

PCT Pub. Date: Jun. 4, 1987

[30] Foreign Application Priority Data

Nov. 22, 1985 [AT] Austria ..... 3423/85
Dec. 5, 1985 [AT] Austria ..... 3528/85
Oct. 9, 1986 [AT] Austria ..... 2681/86

[51] Int. Cl.[5] ..... A63C 9/00
[52] U.S. Cl. ..... 280/615
[58] Field of Search ..... 280/614, 615, 626, 631

[56] References Cited

U.S. PATENT DOCUMENTS 4,484,762 11/1984 Salomon ..... 280/615
4,533,154 8/1985 Bernard et al. ..... 280/615

FOREIGN PATENT DOCUMENTS 375835 9/1984 Austria .
3405861 6/1985 Fed. Rep. of Germany .
2537010 12/1982 France .

*Primary Examiner*—Richard A. Bertsch
*Assistant Examiner*—Michael Mar
*Attorney, Agent, or Firm*—Finnegan, Henderson, Farabow, Garrett & Dunner

[57] ABSTRACT

A ski binding for attachment to a ski and for retaining a ski boot having a hook element extending therefrom, comprises a support structure for disposition on the upper surface of a ski, a horizontal transverse pin attached to the support structure, a pivoting part having a first end, a second end, and a mid-portion disposed between the first and second ends, the first end including a pivot pin disposed thereon, the second end having at least one locking pin extending therefrom, and the mid-portion being pivotably connected to the horizontal transverse pin, an elastic element disposed on the support structure for contacting the pivoting part to resist pivotal movement of the pivoting part about the transverse pin, a boot retaining shell pivotably mounted about the transverse pin for movement between an opened position and a closed position and having a recess disposed therein, the locking pin for projecting through both the recess and the hook element of a ski boot when the retaining shell is in the closed position, and for releasing the hook element of the ski boot when the retaining shell is in the opened position, a spring biasingly disposed between the pivoting part and the retaining shell for urging the retaining shell to the opened position, and a spring plunger pivotably mounted about the pivot pin of the pivoting part for locking the retaining shell in the closed position.

14 Claims, 10 Drawing Sheets

SKI BINDING FOR A CROSS-COUNTRY OR TOURING SKI

BACKGROUND OF THE INVENTION

1. Field of the Invention

The invention relates to a ski binding for a cross-country or touring ski.

2. Description of the Related Art

The type of ski binding mentioned in the introduction is described in Austrian Patent B 357,081. This binding is put on by inserting the sole extension of the ski boot into a retaining shell, during which procedure converging side walls of the stirrup facilitate the insertion. When the retaining shell is then pressed down, which causes the binding to be locked, locking pins enter retaining shell and openings in the sole extension of the ski boot. One disadvantage of this binding is that the retaining shell with its sole plate tilts about an axis located rather far behind and that the swivel axis for the relative motion of the retaining shell and the pivoting part carrying the locking pins lies substantially above the ski surface, thus preventing a natural rolling movement of the sole of the foot on the upper side of the ski. The insertion of the ski boot into the retaining shell from the bottom upwards is unnatural and thus uncomfortable. Furthermore, the anchoring of the retaining shell on the lateral surfaces of the ski is disadvantageous for reasons of stability. Also, arrangement of a movable element projecting outwards from the lateral surfaces of the ski deleteriously affects the skier's motions.

The invention has for its object to adapt, in a ski binding of the kind referred to in the introduction, the skier's stepping into the binding with the ski boot and his striding to the natural motions of the foot and to provide a compact arrangement of the entire ski binding.

This object is achieved by the features of the present invention.

The expedients advocated by the invention ensure an easy and safe stepping into the binding and natural motions during the striding. The whole binding has a compact construction so that there are no components that would protrude from the sides of the ski.

With the ski binding which is described in an older non-prepublished European Application (No. 85112147.5) of the applicant and which constitutes an internal state of the art, retaining shell and pivoting part can be pivoted about a common transverse pin against an elastic element. This transverse pin is held by a supporting structure mounted on the ski. The transverse pin is located in the front area of the two aforementioned components and a spring exerts pressure on retaining shell and pivoting part with the object of forcing them apart. Furthermore, the spring plunger is mounted on an extension of the pivoting part on a pin and, when the binding is in the closed position, locks into a crossbar—provided with a latching groove—of the retaining shell.

Generally, this construction has stood the test of time, but the retention of the ski boot was unsatisfactory, because it wobbled in the retaining shell. In addition, the presence of snow in the binding made stepping-in difficult. Also, there was no expedient that would prevent the spring plunger from opening inadvertently when it strikes an obstacle during striding. The spring that serves to force apart retaining shell and pivoting part is limited in its dimensions, and thus also in its action, because of design considerations. On stepping into the binding, the retaining shell could swing downwards even before the ski boot was firmly seated in the retaining shell because of its limited closing force.

To overcome the disadvantages of this older approach, the invention aims at achieving several objects, which will be discussed hereinbelow. A first object is to improve the retention of the ski boot in the retaining shell, even in the event that there is snow in the binding.

This object is achieved by the present invention.

The expedients taught by the invention ensure good retention of the ski boot in the retaining shell.

By virtue of the expedients of the present invention the optimum angle of the bearing surfaces is fixed at about 45° so that, on the one hand, if snow is deposited on the bearing surfaces the longitudinal displacement of the ski boot does not become excessive, which would be the case if the angles were smaller and would thus lead to a heavy load on the locking pin or on the hook-up element and, on the other hand, the bearing surfaces would still offer the ski boot sufficient lateral support, which would no longer be the case if the angles were greater. The binding will be less sensitive to limit testings because of these expedients.

A combination of the features of the present invention will result in a very advantageous construction of the front area of the ski boot.

The features of the present invention permit a snug fit of the hook-up element to the locking pin.

The present invention also produces other advantageous constructions of the hook-up element.

In addition, the features of the present invention define the supporting surfaces on the ski boot, with which the latter is propped up against the bearing surfaces of the retaining shell. These features also define the guide surfaces of the ski boot, such that the lower guide surface of the ski boot rests on the bottom of the retaining shell and the upper guide surface abuts from below on the guide ledges of the retaining shell.

The present invention also provides a plurality of openings in the retaining shell which ensure that snow in the binding will be expelled upon stepping into the binding. Combining the features of the invention result in guiding the snow in the binding to the openings in the retaining shell.

The present invention results in a design of the surface of the locking pin along which slides the hook-up element upon stepping into the binding until it reaches its final position. The spacings between supporting surfaces and hook-up element are chosen such that the hook-up element is under tensile stress after the ski boot has been inserted into the binding.

According to a second object of the invention, the spring plunger is to be provided with an additional catch without increasing the number of components.

According to the invention, the spring plunger has an additional catch, ruling out inadvertent unlocking during striding due to stresses and shocks.

The third object is to ensure that stepping into the binding always occurs under controlled conditions.

As a result of the expedients taught by the invention, the closing force of the retaining shell is increased upon stepping into the binding without additional parts and without reinforcing the springs that serve to ensure that stepping into the binding always occurs under controlled conditions.

The present invention ensures that the angle of traverse of the spring plunger during the closing of the binding is equal to the minimum angle of traverse during the opening thereof.

By virtue of the construction of the invention, the position of the spring plunger and of the retaining shell relative to each other in the open position of the binding is fixed.

In all the versions described above, the spring plunger, during the entire stepping-out procedure, must be held in the position in which he releases the pivoting part.

Accordingly, the invention has as fourth object the overcoming of this drawback as well and the provision of a ski binding in which the user has the possibility of supporting himself on the cross-country track with both ski poles during the stepping-out procedure.

A ski binding for cross-country skiing as taught by West German Patent A1 34 05 861 features a base plate which extends towards the tip of the ski in two cheeks, between which is a placed a grip lever which is under the influence of a torsion spring. The torsion spring presses the grip lever against a hold-down clamp for the ski boot sole and which can be pivoted about a further transverse pin placed between the cheeks and on which a step spur is also mounted. The step spur locks with its end from below into a recess of the sole of the ski boot.

In the stepping-in position of the binding, the hold-down clamp is held in place by the grip lever in that a guide curve of the grip lever laps over a cam of the hold-down clamp. When the sole of the ski boot approaches the base plate during the stepping-in procedure, the cam migrates along the guide curve and when the culmination point is exceeded, the hold-down clamp is swung into the locking position.

This binding has the drawback that the stepping motion of the skier is produced only by the elasticity of the sole of the ski boot but not by a joint plate in the binding. Therefore, this prior type of solution differs from the subject matter of the invention.

Obviously, various approaches are possible for the practical construction of the spring plunger, but the design defined in the invention has proved particularly suitable. With this design, only one additional torsion spring is needed to produce the desired effect.

In principle, it would be possible, in order to retain the leg of the torsion spring projecting into the groove of the spring plunger and which is relatively small in size, to provide a flat part in the bottom of the arcuate groove, on which the end of the spring is fixed by friction. However, this could occasionally lead to an unintentional swing of the spring plunger. This is prevented by the present invention.

The present invention overcomes the danger that the tip of the torsion spring leg does not get stuck in the spring plunger.

The present invention enables the spring plunger to return automatically to its indexed position as soon as the end of the leg has been pressed by the crossbar of the retaining shell over the latching projection of the groove.

The present invention increases the operational safety of the ski binding, since the necessary spring force is split into two halves of a stirrup, thereby considerably reducing the danger of buckling of the loaded leg of the torsion spring.

Further features, advantages and details of the invention will now be described in more detail in conjunction with the accompanying drawings in which two specific embodiments of retaining shell and ski boot, as well as two embodiments of the spring plunger, have been set forth for purposes of illustration.

SUMMARY OF THE INVENTION

A ski binding for attachment to a ski and for retaining a ski boot having a hook element extending therefrom, comprises a support structure for disposition on the upper surface of a ski, a horizontal transverse pin attached to the support structure and extending transverse to the upper structure of the ski, a pivoting part having a first end, a second end, and a mid-portion disposed between the first and second ends, the first end including a pivot pin disposed thereon, the second end having at least one locking pin extending therefrom, and the mid-portion being pivotably connected to the horizontal transverse pin, an elastic element disposed on the support structure for contacting the pivoting part to resist pivotal movement of the pivoting part about the transverse pin, a boot retaining shell pivotably mounted about the transverse pin for movement between an opened position and a closed position and having a recess disposed therein, the locking pin for projecting through both the recess and the hook element of a ski boot when the retaining shell is in the closed position, and for releasing the hook element of the ski boot when the retaining shell is in the opened position, a spring biasingly disposed between the pivoting part and the retaining shell for urging the retaining shell to the opened position, and a spring plunger pivotably mounted about the pivot pin of the pivoting part for locking the retaining shell in the closed position.

DESCRIPTION OF THE PREFERRED EMBODIMENTS

Figure 1:
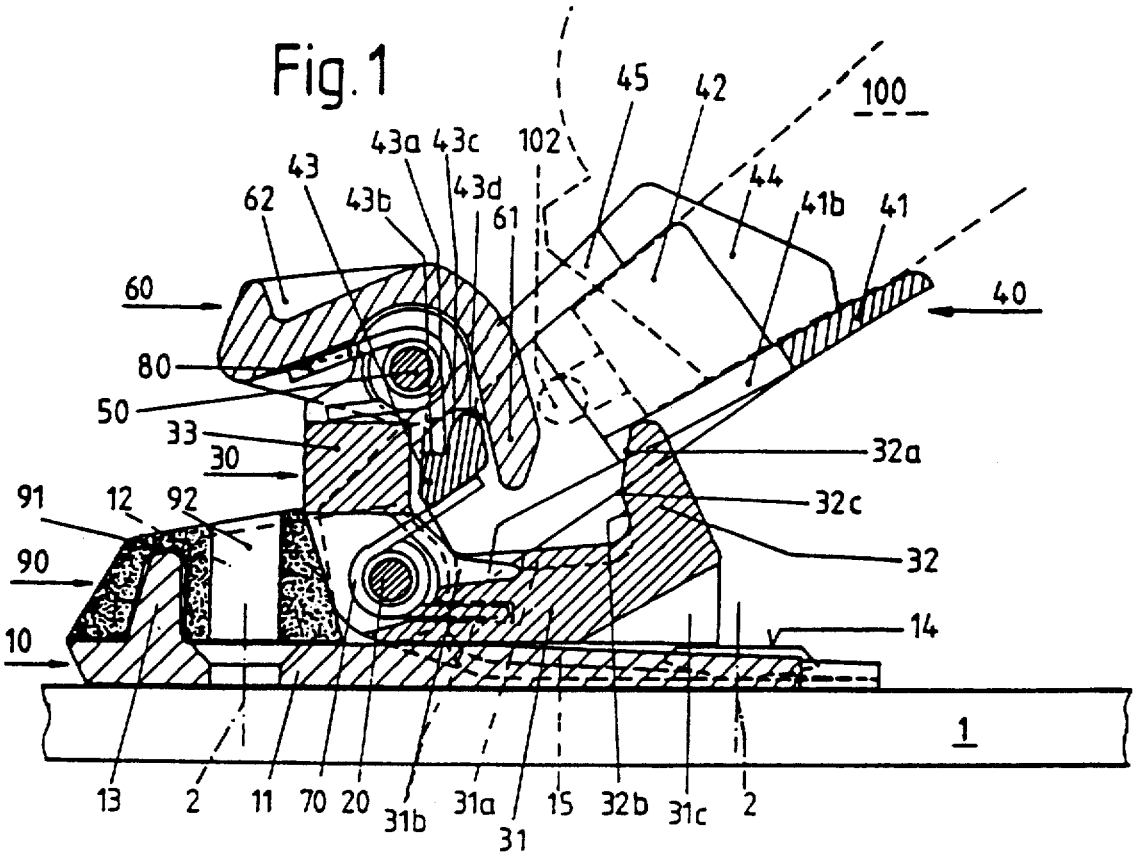
FIG. 1 depicts the ski binding incorporating the present invention in the open, (stepping-in) position.

The first embodiment depicted in FIGS. 1 to 7 and 10 to 12 represents a ski binding for a cross-country or touring ski 1 and a ski boot 100 associated therewith. On the upper side of a ski 1 is mounted a supporting structure 10 by means of springs 2. It is made up of a base plate 11 with two walls 12 which start out on the end portion of the base plate 11 and lead approximately to the center of the base plate 11 and carry a transverse pin in the latter area. The plate 11 carries on its front end a rib 13 and on its rear end a bearing surface 13 in which the screws 2 are countersunk.

Figure 6:
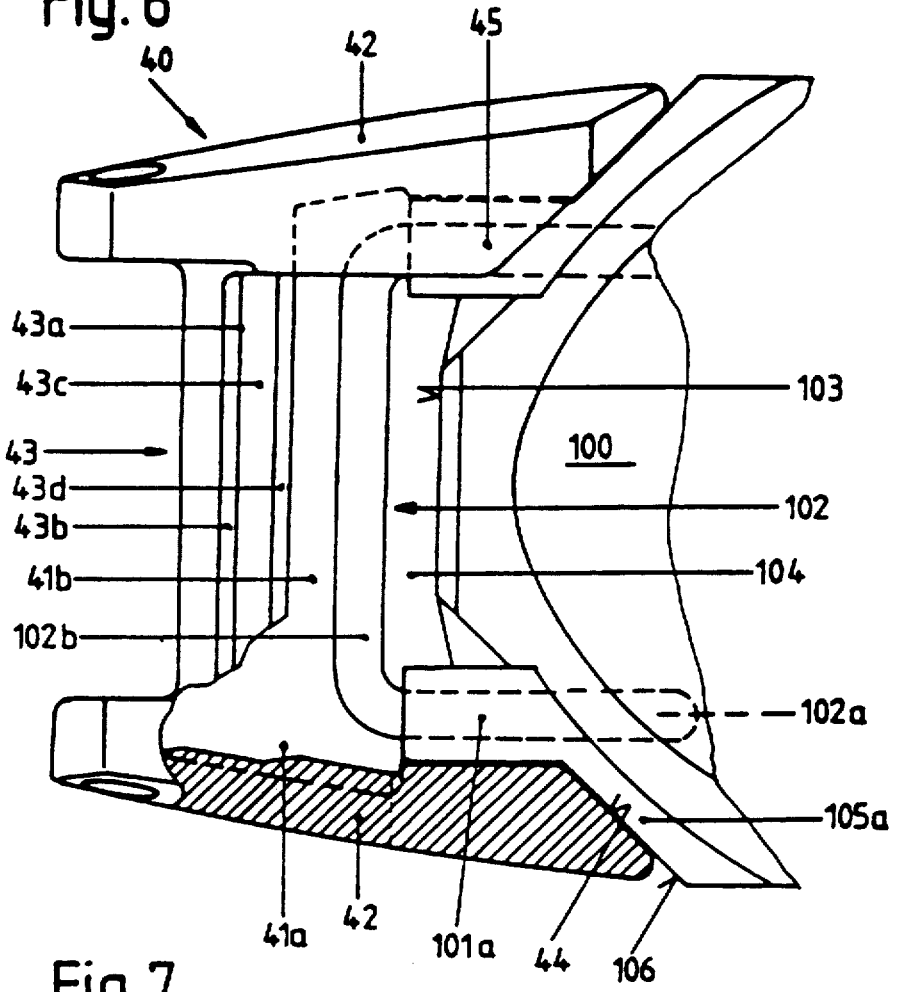
FIG. 6 a plan view of a first embodiment of the retaining shell of the ski binding with the ski boot inserted therein.

On the transverse pin 20 is mounted a pivoting part 30, which rests with its bottom 31 on the bearing surface 14 of the supporting structure 10. The bottom 31 has, on its side facing away from the ski 1, surfaces 31*a* that drop off obliquely outwards from the longitudinal axis of the binding. On the end remote from the transverse pin 20 the bottom 31 carries a locking pin of locking beam 32. There is also mounted on the transverse pin 20 a retaining shell 40, the bottom face 41 of which has a release 41*b* for the locking pin 32 and further openings 41*a* (FIG. 6). Guide ledges 45 are attached at the top to the side walls 42 of the retaining shell 40, which, in their front portion, are connected to a crossbar 43 provided with a latching groove 43*a* and have bearing surfaces 44 in their rear area remote from the transverse pin 20.

An extension 33 of the pivoting part 30 projecting upwards from the transverse pin 20 carries at its upper end a pin 50, to which is hinged a spring plunger 60, which is formed as a two-arm lever and carries on its arm turned toward the retaining shell 40 a fillet-shaped stop 63 (FIGS. 10–12), and a detent 61 and, on its second arm turned away from the ski 1, depression 62.

In the bottom 31 of the pivoting part 30 are provided appropriate cavities 31*b* for a spring around the transverse pin 20 to which pressure is applied in order to force the retaining shell 40 and the pivoting part 30 apart. An interlock spring 80 around the pin 50 biases the spring plunger 60 in the direction of closing to the retaining shell 40.

An elastic element 90 is inserted into the front portion of the supporting structure 10 such that it rests with its recess 91 above the rib 13 of the base plate 11 and is thus supported against the pivoting part 30 with its portion turned away from the rib 3. The elastic element 90 has a hole 92 in order to be able to insert the screw 2 without hindrance during the mounting of the binding on the ski 1.

Figure 7:
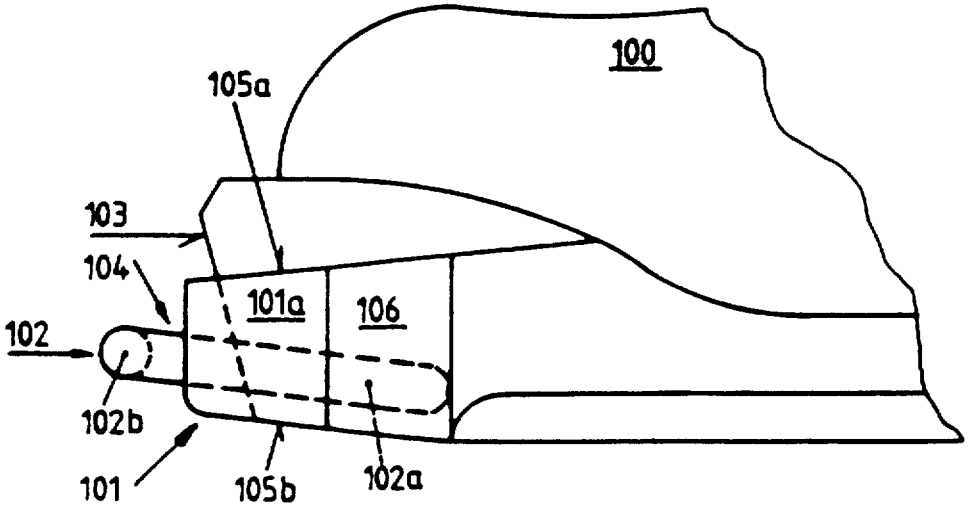
FIG. 7 a side view of a first embodiment of the ski boot for use in conjunction with the present invention.

The ski boot to be inserted into the binding 100 as shown in FIG. 7 has in its front area a sole extension 101 made up of extensions 101*a* and a U-shaped hook-in element 102 integrally cast therein with its legs 102*a*. An opening 104 is formed between the hook-in element 102 and the end surface 103 of the sole. Viewed from the side, the front area of the sole has conical guide surfaces 105*a*, 105*b*, the lower guide surface 105*b* being intended to be put on the bottom surface 41 of the retaining shell 40. The angle between the upper guide surface 105*a* and the lower guide surface 105*b* is identical to the angle between the bottom surface 41 and the guide ledges 45 of the retaining shell 40, since in the case of the ski boot 100 inserted into the binding the upper guide surface 105*a* is to abut from below on the guide ledges 45 of the retaining shell 40. The sole area provided with the guide surfaces 105*a*, 105*b* features supporting surfaces 106 which, after the ski boot 100 has been inserted, abut thereon in parallel to the bearing surfaces 44 of the retaining shell 40.

Figure 8:
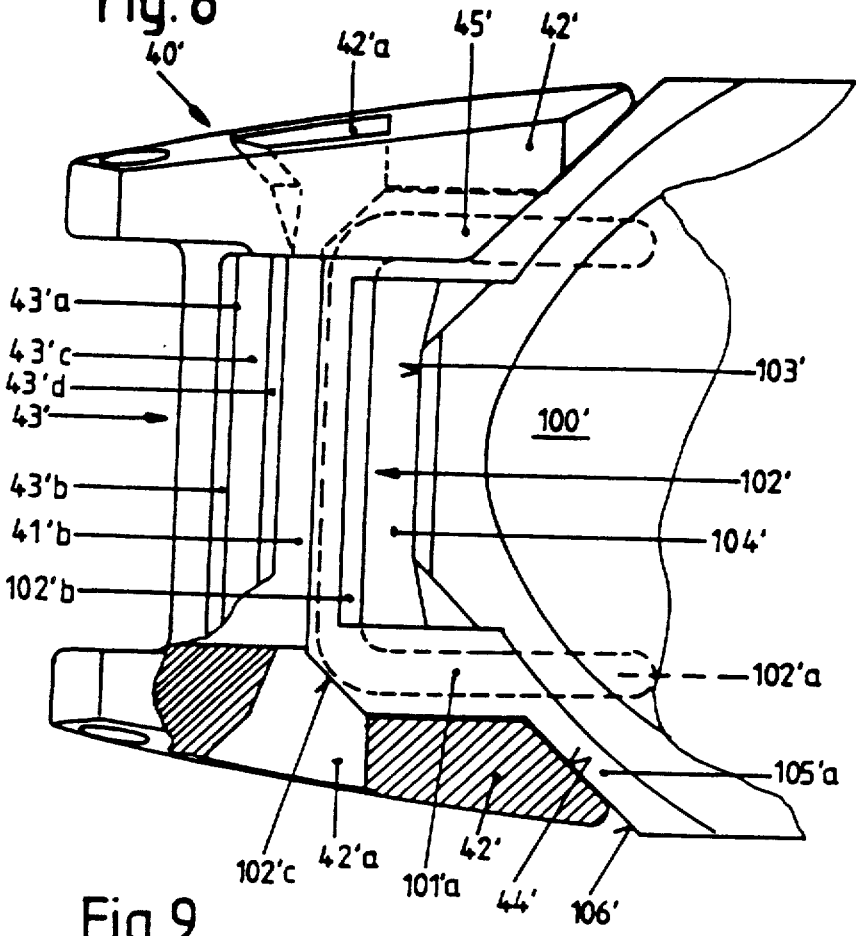
FIG. 8 depicts a plan view of a second embodiment of the retaining shell of the ski binding after the ski boot has been inserted.
Figure 9:
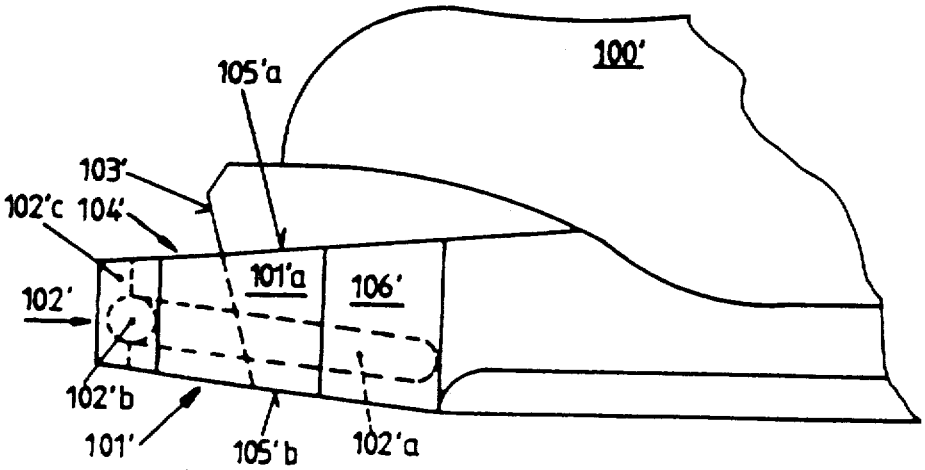
FIG. 9 depicts a side view of a second embodiment of the ski boot.

In a second embodiment illustrated in FIGS. 8 and 9, outwardly flaring openings 41'*a* are provided in the side walls 42' of the retaining shell 40'. The ski boot 100' associated with this embodiment has bevelled surfaces 102'*c* on the external surface of the hook-in element 102' surrounded with sole material.

When stepping into the binding shown in FIG. 1, the ski boot 100 is inserted obliquely upwards with its guide surfaces 105*a*, 105*b* into the retaining shell 40 until it abuts with its hook-in element 102 on the detent 61 of the spring plunger 60, after which it is stepped down, with the retaining shell 40 being swung downwards against the force of the spring 70 and partly against that of the interlock spring 80. In the process, the locking pin 32 enters from below the opening 104 in the sole extension 101 of the ski boot. The bevel of the linear segment 32*a* of the locking pin 32 serves, in the first phase of the stepping down of the retaining shell, to facilitate the threading of the locking pin 3 into the opening 104 until the ski boot 100 abuts with its supporting faces 106 on the bearing surfaces 44 of the retaining shell 40. In the second phase, the hook-in element moves further along the linear segment 32*a*, but under increasing tensile stress. In the third phase of the stepping-down process, starting from the transition point 32*c* from the linear segment 32*a* to the circular arc segment 32*b*, the tensile stress remains constant, as the hook-in element 102 is moving along the circular arc segment 32*b* to its final position, since the circular arc segment 32*b* has its center in the transverse pin 20. At the same time, the crossbar 43 slides down along the interior of the detent 61 while applying pressure thereon in the direction of opening (FIGS. 10–11) until the detent 61 locks into its latching groove 43*a*, thereby fixing its position. Stepping into the binding occurs against a stepping-in force, which is higher than the force of the spring 70 designed as a setup spring, in that additional pressure is applied to the interlock spring 80 during the pivoting of the retaining shell 40. This solution results merely by constructional steps when designing spring plunger 60 and crossbar 43 of the retaining shell 40, thereby enlarging the angle of traverse ($\alpha$) of the spring plunger (60) upon stepping into the binding and thereby compressing the interlock spring 80 more heavily. Because the stepping in occurs against the increased spring force, premature, uncontrolled closing of the binding is avoided as long as the ski boot 100 is not stuck in the retaining shell 40. In the first embodiment, snow in the binding is expelled during the stepping-in procedure through the openings 41*a* in the bottom surface 41 of the retaining shell 40. In the second embodiment, the snow is passed through the bevelled surfaces 102'*c* on the hook-in element 102' to the openings 42'*a* in the side walls 42' of the retaining shell 40' and expelled therethrough. Furthermore, snow between pivoting part 30 and retaining shell 40 is passed to the outside through the bevelled surfaces 31*a* on the bottom 31 of the pivoting part 30.

Figure 2:
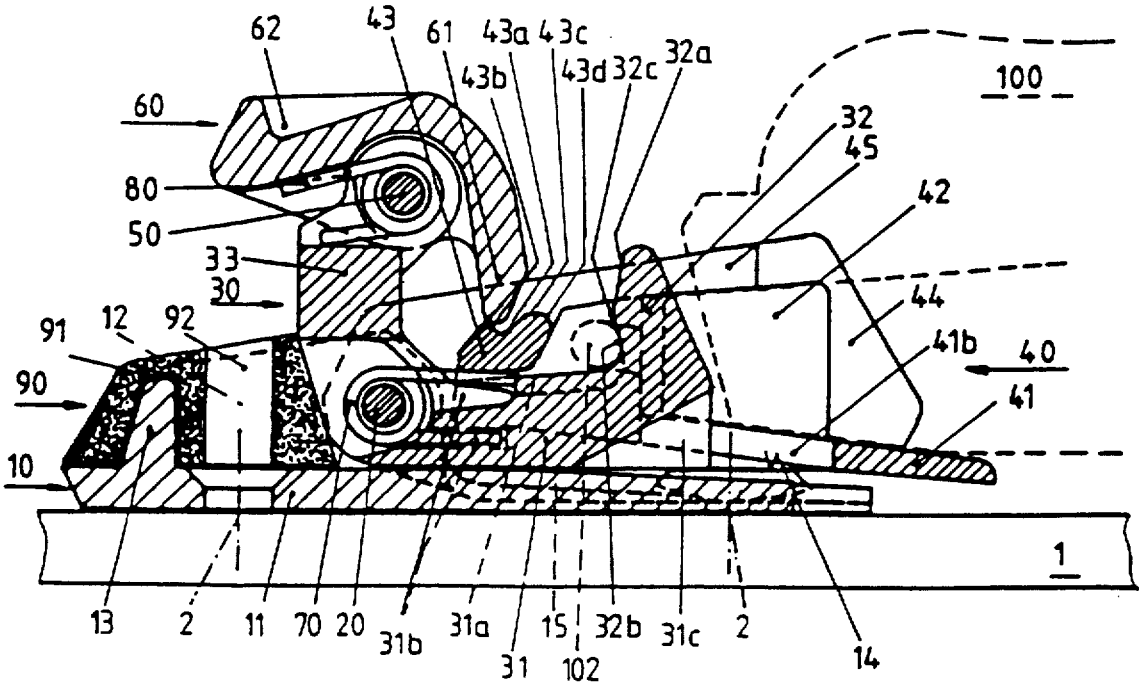
FIG. 2 the ski binding in skiing position taken along the line I—I in FIG. 5.

After the retaining shell 40 has been completely lowered to the ski 1, when the latter rests on the bearing surface 14 of the base plate 11, as is the case in the skiing position shown in FIG. 2, the hook-in element 102 has assumed its lowest position in the circular arc segment 32*b* of the locking pin 32, while the detent 61 of the spring plunger 60 abuts on the wall 43*b* lying in the direction of closing of the spring plunger 60. In this position, which is also taken by the user while standing, the spring plunger 60 can be opened by inserting the tip of a ski pole into its depression 62 and exerting pressure against the force of the interlock spring 80, during which the ski boot 100, by lifting it, springs out of engagement with the locking pin 32 and can then be pulled out of the retaining shell 40.

Figure 3:
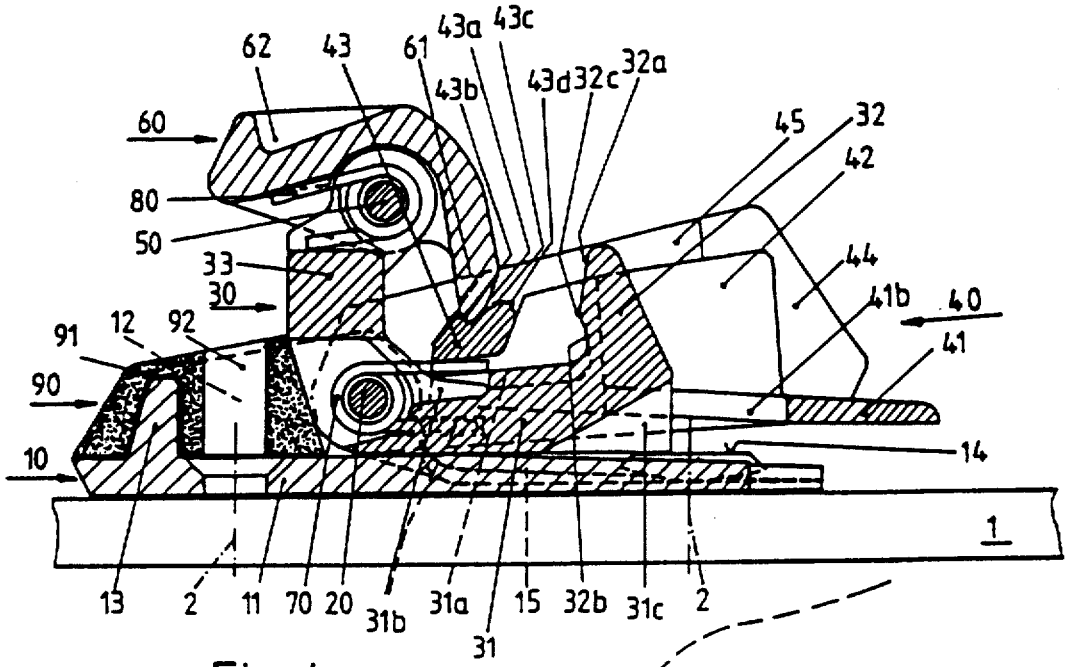
FIG. 3 depicts the ski binding of FIG. 1 in the closed position, but not loaded by the ski boot.
Figure 4:
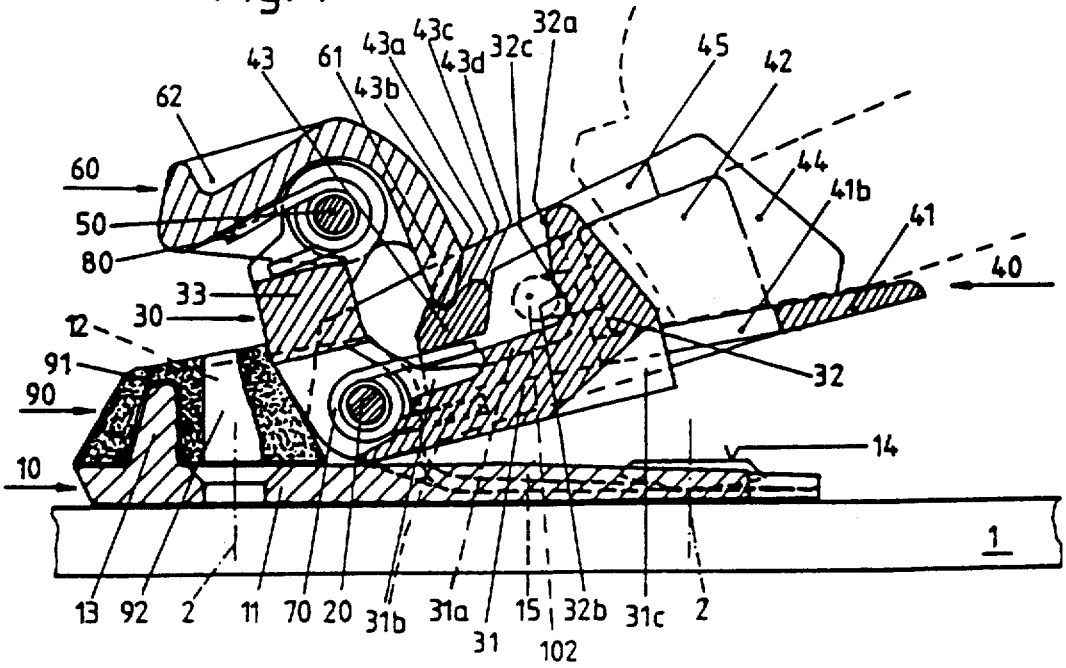
FIG. 4 depicts the ski binding of FIG. 1 in the "go" position.
Figure 3A:
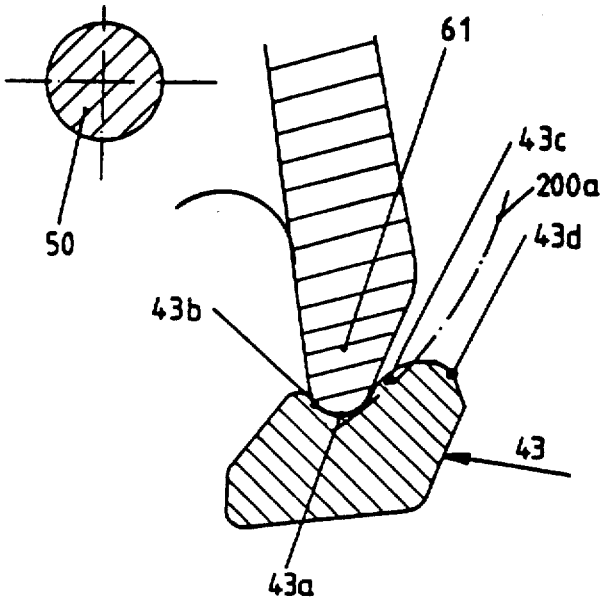
FIG. 3*a* is a detailed view of a portion of FIG. 3.
Figure 5:
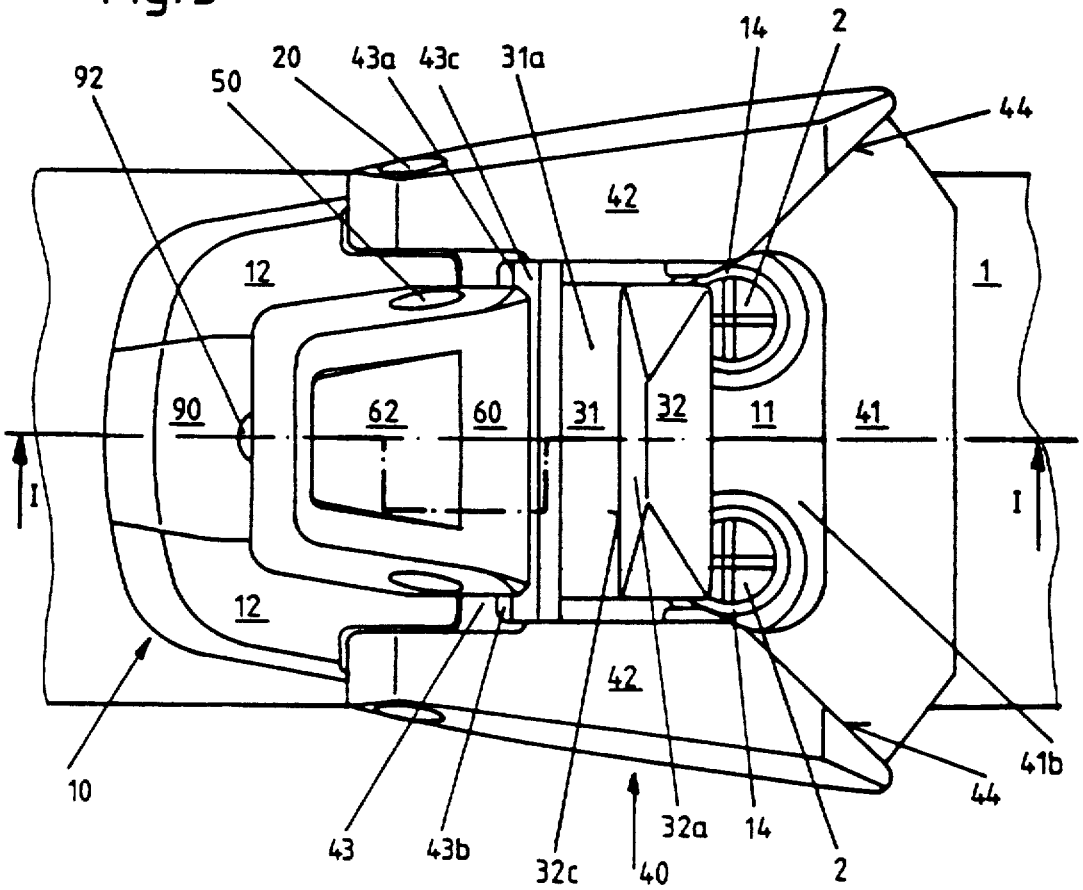
FIG. 5 a plan view of the ski binding of FIG. 1 in the skiing position.

FIG. 3 shows the binding in its closed position, but not loaded by the ski boot 100. Due to the biasing by the spring 70, the retaining shell 40 rises until the detent 61 of the spring plunger 60 lies completely in the latching groove 43*a*. In this position, of which in FIG. 3*a* the engagement of the detent 61 of the spring plunger 60 in the crossbar 43 of the retaining shell 40 is shown on a larger scale, the spring plunger 60 cannot be opened. In FIG. 3*a*, the path of the detent 61 during the pivoting of the spring plunger 60 in the direction of opening is plotted in dot-dash lines as a circular arc 200*a* around the pin 50. However, the spring plunger 60 is prevented from said pivoting by an elevated area 43*c* of the wall of the crossbar 43 lying in the direction of opening of the spring plunger 60 and which therefore represents an additional safety catch for the spring plunger 60. When a ski boot 100 is inserted into the binding, it runs through the position shown in FIG. 3 in the first phase of the striding. Due to the relative motion of the retaining shell 40 with respect to the pivoting part 30, the hook-in element 102 of the ski boot 100 lies in this position in the upper region of the circular arc segment 32*b* of the locking pin 32. Upon further raising of the ski boot 100 in FIG. 4, one maintains, on the one hand, the indexed position between spring plunger 60 and crossbar 43 of the retaining shell 40 on the one hand and the position of the hook-in element 102 in the circular arc segment 32*b* of the locking pin 32 on the other, so that retaining shell 40 and pivoting part 30 form one unit and together they swivel in counterclockwise direction against the force of the elastic element 90. Snow that accumulates in the binding during the striding is expelled from the binding through oblique snow-expelling surfaces 15, 31*c*, which are formed both on the base plate 11 and on the underside of the pivoting part 30.

One of the essential elements of the invention is the fact that the spring plunger 60 and the crossbar 43 of the retaining shell 40 are so adjusted to each other that the spring plunger 60 assumes an accurately defined position both in the open and closed positions. This position is fixed by the position of spring plunger 60 and retaining shell 40 relative to each other, which, in the open position of the binding, results from the abutment of an elevated area 43*d* of the crossbar 43 on the fillet-shaped stop 63 of the spring plunger 60 and, in the closed position, by abutment of the detent 61 of the spring plunger 60 on the wall 43*b* of the latching groove 43*a* of the crossbar 43 lying in the direction of closing of the spring plunger 60.

Figure 10:
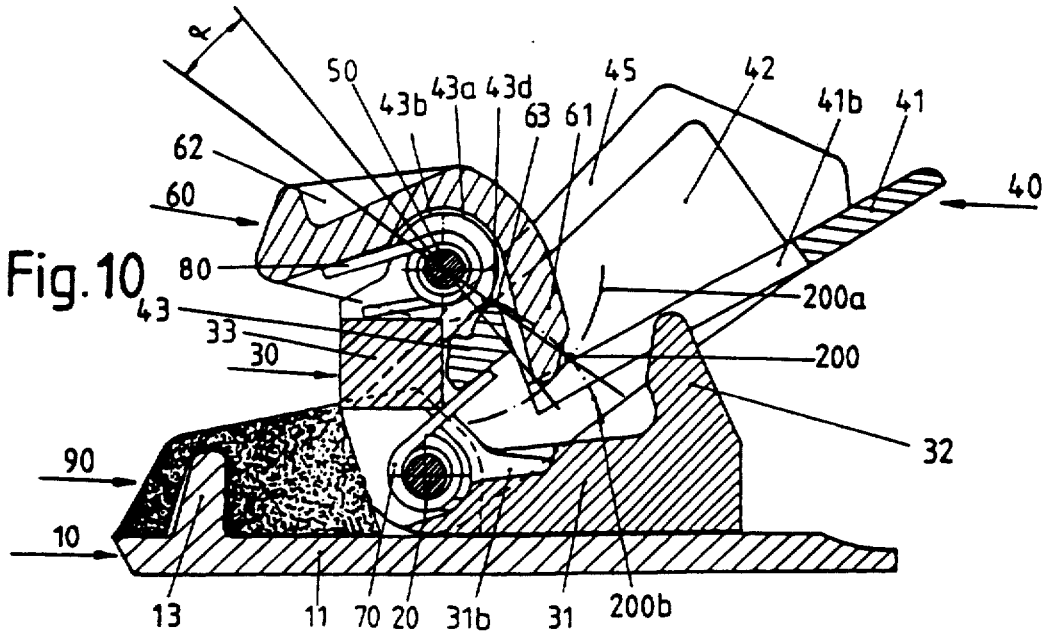
FIG. 10 depicts a ski binding in accordance with the invention similar to FIG. 1.
Figure 11:
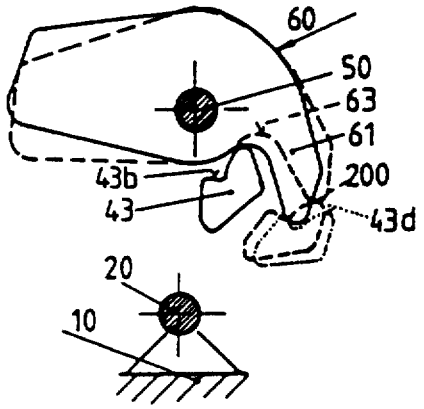
FIG. 11 depicts maximum swing of the spring plunger during the closing of the retaining shell.
Figure 12:
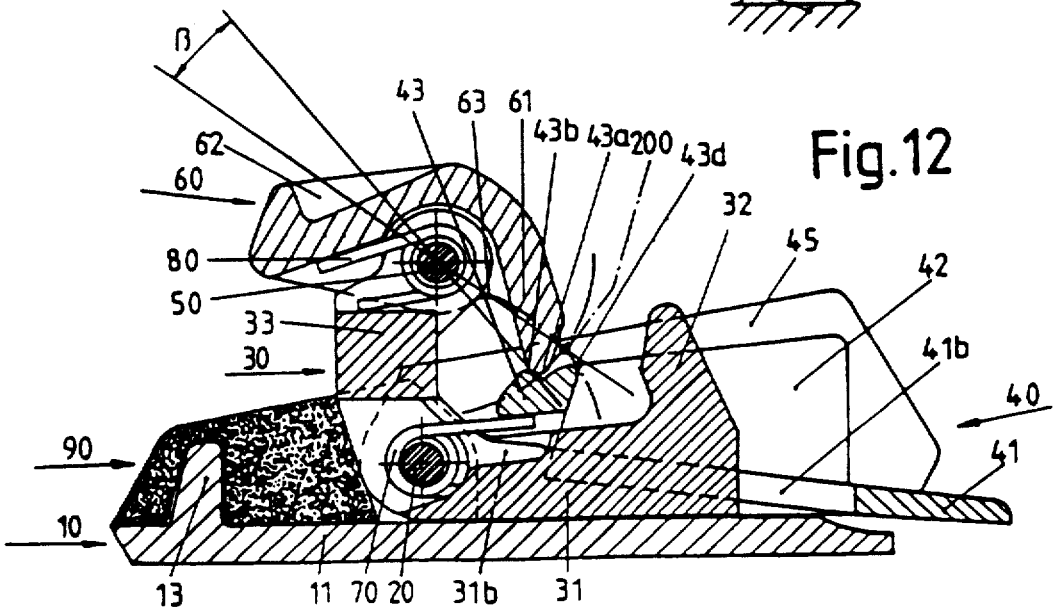
FIG. 12 depicts a ski binding in accordance with the present invention similar to FIG. 2.

In the specific embodiment shown in FIGS. 10 to 12, the spring plunger 60 and the crossbar 43 of the retaining shell 40 are so adjusted to each other that the position of the spring plunger 60 in the open and closed positions of the binding are the same. Both during the opening and during the closing of the binding, the elevated area 43*b* of the crossbar 43 of the retaining shell 40 and the detent 61 of the spring plunger 60 slide past each other, during which the retaining shell 40 swings in one direction and the spring plunger 60 carries out a rocking motion, during which the spring plunger 60 attains a maximum swing, after which it returns to its initial position. The position of the maximum swivel is fixed by the intersection point 200 of two curves, i.e. by the circular arcs 200*a* which is described by the elevated area 43*d* of the crossbar 43 around the transverse pin 20. Since in this specific embodiment, the position of the spring plunger 60 is the same in the closed as well as in the open position and the intersection point 200 has a fixed position, the angle of traverse 24 ($\alpha$) of the spring plunger 60 during the closing of the binding is identical to the minimum angle of traverse ($\beta$) during the opening of the binding. In FIG. 11 the swinging of the spring plunger 60 and of the retaining shell 40 is shown with all the other compo-nents being left out, and only the crossbar 43 of the retaining shell 40 is shown. The position of the spring plunger 60 and retaining shell 40 in the open position of the binding is shown in solid lines. During the closing of the binding, i.e., when the retaining shell 50 is being swung down, the crossbar 43 slides down with its elevation 43*d* along the interior of the detent 61, during which it applies pressure to the spring plunger 60 in the direction of opening, until it attains the position of its maximum swing which is shown in FIG. 11 with dotted lines. After this position has been exceeded, the retaining shell 40 swings further and the spring plunger 60 abuts with its detent 61 on the wall 43*b* of the crossbar 43 lying in the direction of closing of the spring plunger 60, with the spring plunger 60 returning again to its initial position. The position of the crossbar 43, when the binding is closed, is shown with dotted lines in FIG. 11.

Except for the shape of the spring plunger and its spring plunger, the ski binding shown in FIGS. 13 to 20 corresponds to the design of what has been described thus far. Therefore, the other parts of the ski binding are given like reference numerals, even if they differ slightly from the versions shown earlier. The spring plunger and its spring plunger are denoted with numbers above 300 for better differentiation.

On the transverse pin 20 there is mounted, in addition to the spring 5 as detent for the spring plunger 360, an additional torsion spring 306, which is operatively connected to the spring plunger 360 in a manner to be described in more detail hereinbelow.

In the lever arm of the spring plunger 360 carrying the detent 361 there is cut out a groove 364 with a rectangular cross section. At the bottom of the groove 364 is formed, near its end away from the shaft 40, a latching projection 365. The groove 364 extends archlike between the latching projection 365 and the end of the groove 364 adjacent to the pin 50.

The above described torsion spring 306, one of the legs 306*a* of which is anchored in the pivoting part 30, locks with its other leg 306*b* into the groove 364. As shown in FIGS. 17 to 20, the end 306*c* of this leg 306*b* has the form of a circular arc, but it may also be provided with a roller. If a normal plane is passed to the axis of the leg at the point of contact between the end 306*c* of the leg 306*b* and the bottom of the groove 364, the latter will enclose with a tangential plane on the bottom of the groove an angle gamma which is greater than the angle of friction between the materials of the spring plunger 360 and of the torsion spring 306.

Figure 14:
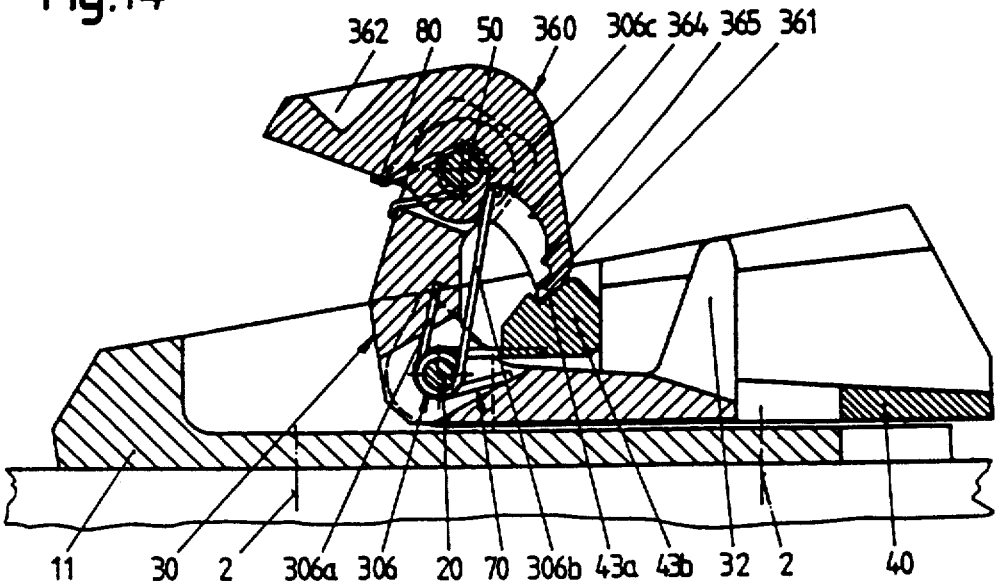
FIG. 14 depicts a sectional view taken along the line XIV—XIV in FIG. 13.
Figure 13:
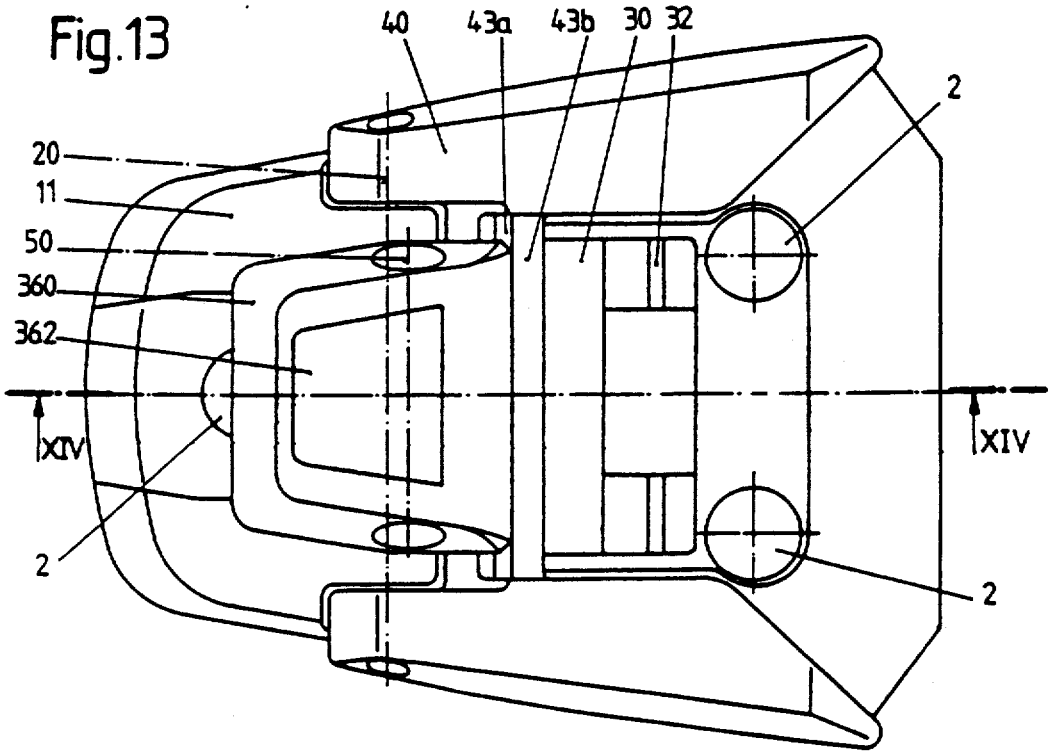
FIG. 13 the ski binding in the skiing position and having a modified spring plunger.
Figure 15:
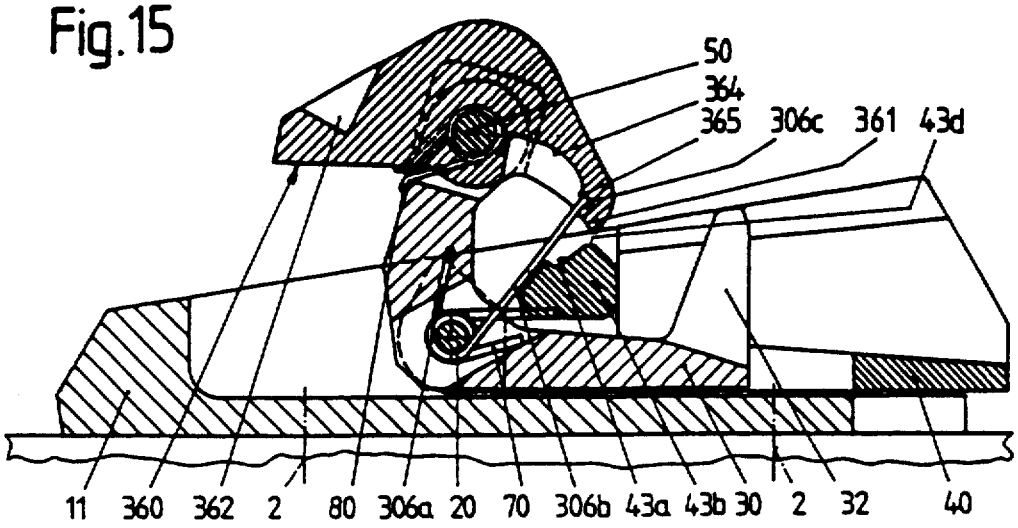
FIG. 15 depicts the ski binding of FIG. 13 with the spring plunger unlocked.
Figure 18:
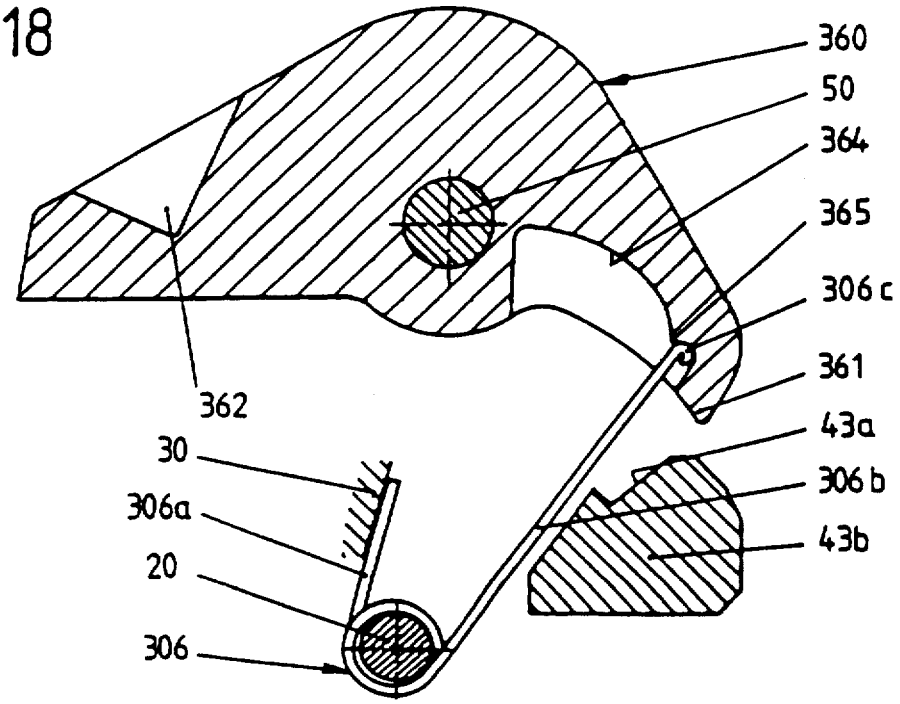
Figure 19:
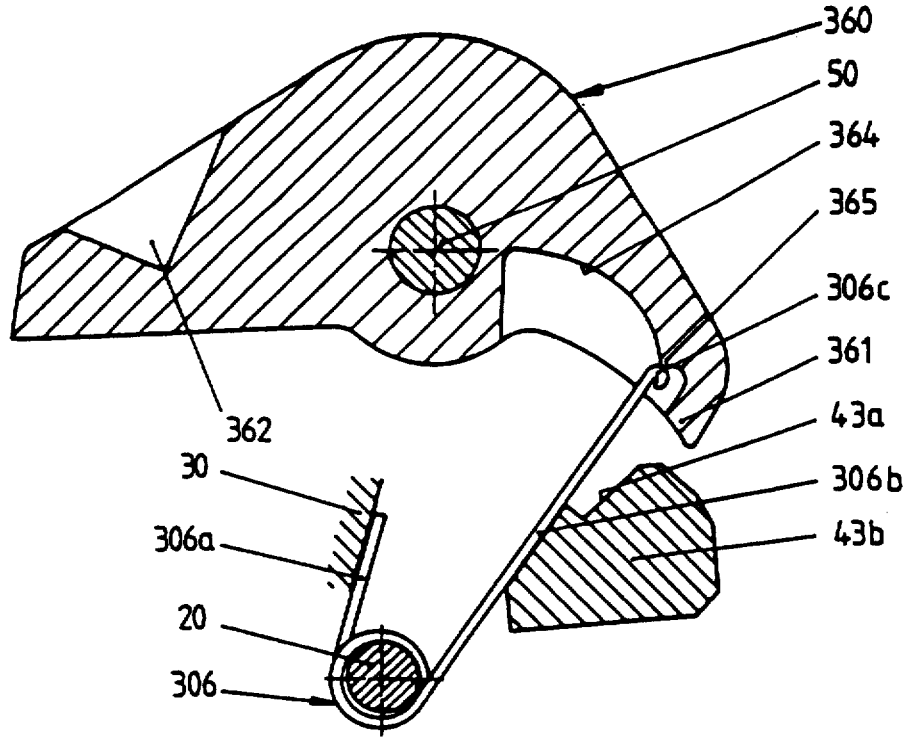
Figure 20:
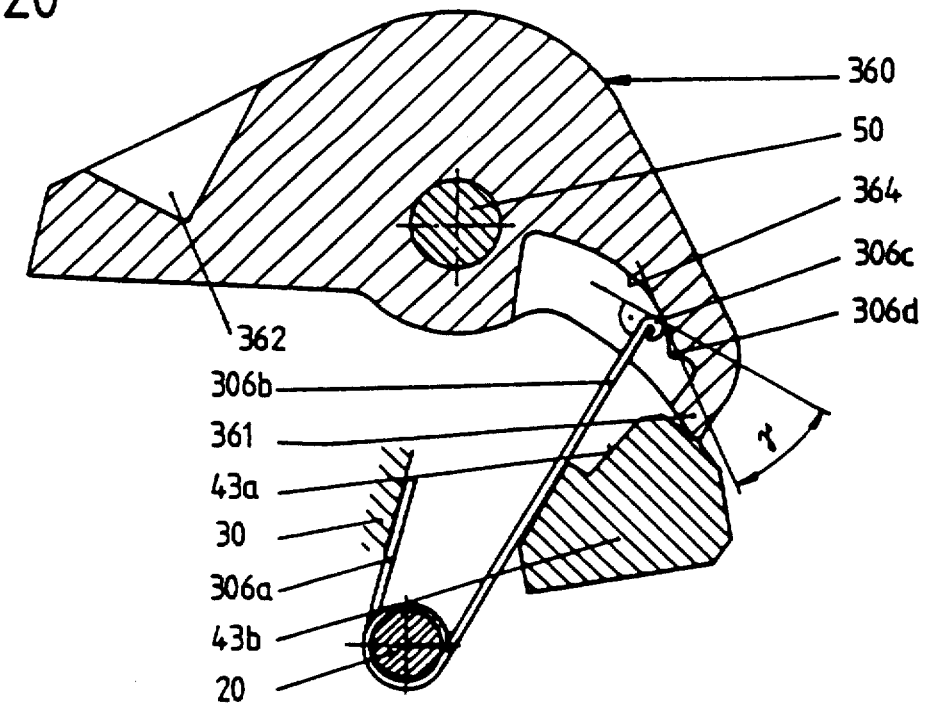

For a better understanding of the effects that can be achieved by a modification of the spring plunger 360, we will first repeat briefly the function of the ski binding in accordance with the earlier versions and then explain the function of the modified version. Here, FIG. 17 corresponds to the skiing position of the ski binding, such as illustrated in FIG. 14, and FIG. 18 corresponds to the ski binding with the spring plunger detached. In FIGS. 19 and 20 are shown intermediate positions of the spring plunger and of one leg of the torsion spring during the stepping-out procedure.

The function of the ski binding in accordance with the earlier versions is as follows: Upon stepping into the open binding, the ski boot not shown herein is pushed obliquely from above into the retaining shell 40.

Figure 16:
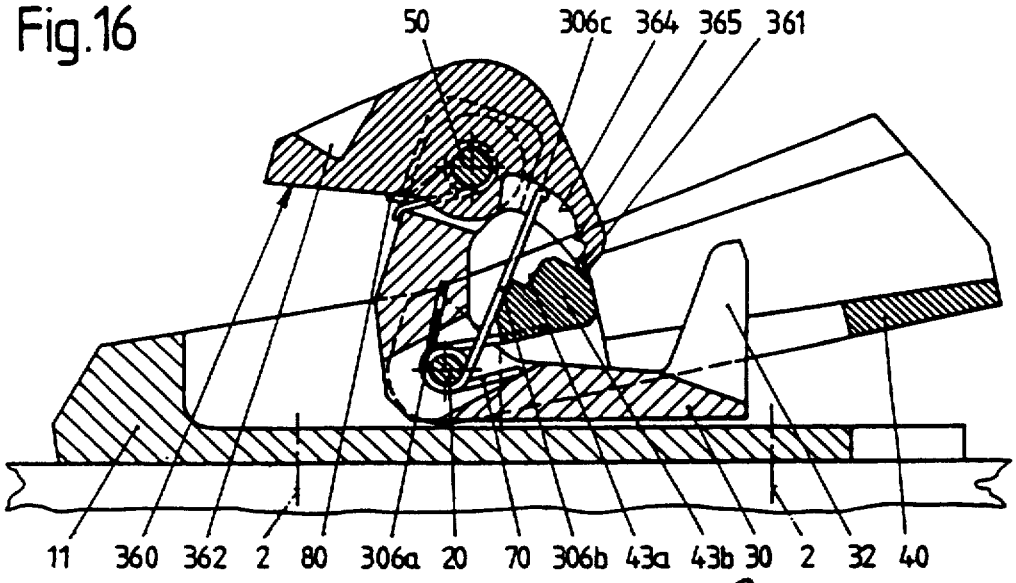
FIG. 16 depicts longitudinal median section of the ski binding during the stepping-out procedure.

Then, the ski boot together with the retaining shell 40 is swung downwards through the position in FIG. 16 to the position in FIG. 14 and locked in position by the locking pins 32, which enter the through-holes in the sole extension. The spring plunger 360, which can be pivoted about the pin 50, slides with its detent 361 over the crossbar 43 of the retaining shell 40 (see FIG. 16) and is finally locked in the latching groove 43*a* of the crossbar 43 (cf. FIG. 14). This closes the binding, and the retaining shell 40 as well as the pivoting part 30 can be pivoted together about the transverse pin 20 against the action of an elastic element (cf. the element 90 in FIG. 1) not shown herein.

Figure 17:
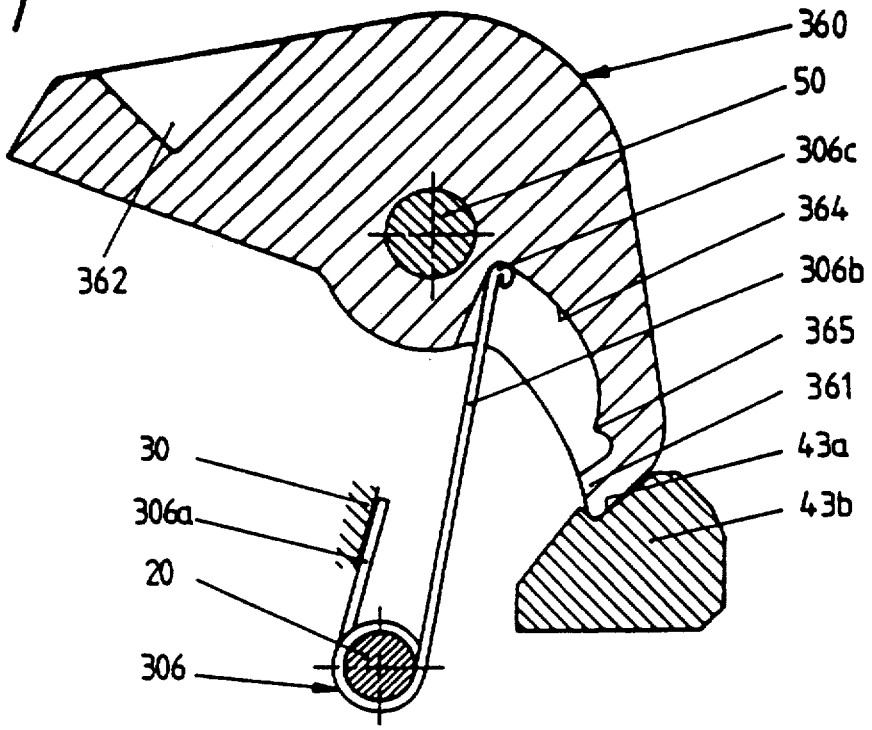
FIGS. 17–20 are detailed view of portions of FIGS. 14–16.

If, however, the skier desires to step out of the binding with the ski boot, he presses the tip of his ski pole into the depression 362 of the spring plunger 360, thereby swivelling the latter in counterclockwise direction against the force of the interlock spring 80 shown in FIGS. 14 and 17. At the same time, the detent 361 is lifted out of the latching groove 43*a of* the crossbar 43 of the retaining shell 40, so that the crossbar can be swung so long relative to the pivoting part 30 that the locking pins 32 leave the recesses in the sole extension of the ski boot, whereby the skier must press down with his ski pole the spring plunger 360 in the open position during the entire stepping-out procedure.

Now, in order to facilitate this stepping-out procedure, the spring plunger 360 is locked by the leg 306*b* of the torsion spring 306 in the pivoted position in accordance with the modification of the invention (see FIGS. 15 and 18), with the result that the skier, during the stepping-out procedure, must not hold the spring plunger 360 in the pressed-down condition. Rather, he can support himself with his two ski poles on the cross-country track during the stepping-out procedure.

During this stepping-out procedure, the leg 306*b* of the torsion spring 306 is pressed with a short unproductive movement through the crossbar 43 of the retaining shell 40 via the latching projection 365 of the spring plunger 360, whereby its detent 361 has already reached the upper terminal area of the crossbar 43 of the retaining shell 40 (FIG. 19). The result is that the torsion spring 306, upon further upward swinging of the retaining shell 40 by means of the crossbar 43 and supported by the interlock spring 80, is swung (pressed) back to its stand-by position.

Thus, the torsion spring 306 is automatically returned to its initial position if there is any random detachment. The unproductive movement mentioned above is dimensioned such that the upperside of the crossbar 43 of the retaining shell 40 is overlapped by the detent 361 of the spring plunger 360 during the stepping-out procedure, so that re-engagement or locking is ruled out (FIGS. 19 and 20). Thus, the binding is prepared for a new stepping-in procedure.

Figure 21:
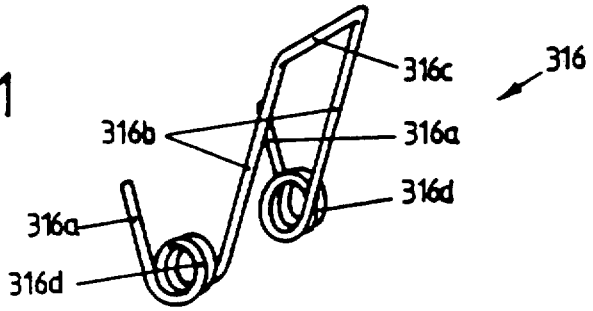
FIG. 21 depicts a schematic view of a modification of the spring plunger in accordance with the present invention.

The torsion spring depicted in FIG. 21, which corresponds to the torsion spring 306 of the preceding specific embodiment shown in FIGS. 13 to 20, is generally denoted 316. This torsion spring 316—viewed from the side—is shaped essentially like a U. It has two legs 316*a*, which are anchored in the pivoting part 360 of the binding. The two other legs 316*b* are interconnected by a crossbar 316*c*. This crossbar 316*c* is passed in the correspondingly wide groove of the spring plunger 360. The turns 316*d* of the torsion spring 316 disposed between the legs 316*a* and 316*b* are arranged on the transverse pin 30 of the ski binding mounted in the supporting structure 10.

The invention is not limited to the specific embodiments discussed hereinabove. In the second embodiment, the construction of the crossbar of the retaining shell with an elevated area for additional locking of the spring plunger can also be effected in accordance with FIGS. 8 and 9. In the second embodiment, the reinforcement of the closing force of the retaining shell can also be realized in like manner. Should the closing force of the retaining shell be increased further, the position of the spring plunger when the binding is open must be tilted more strongly in its direction of closing than in the closed state, so that the spring deflection during the closing of the binding will be greater. This could, for example, be achieved by means of a fillet-shaped stop which is milled more deeply in the spring plunger. By giving the spring plunger and the crossbar different designs, the position of the spring plunger—with the binding open and closed—can be varied, so that the distance of the angle of traverse of the spring plunger during the closing of the binding can be varied.

Furthermore, the end of the corresponding leg of the torsion spring passed in the groove of the spring plunger can also be provided with a rounded, e.g., spherical, head.

We claim:

1. A ski binding for attachment to a ski and for retaining a ski boot having a hook element extending therefrom, the ski binding comprising:

a support structure for disposition on the upper surface of a ski;

a horizontal transverse pin attached to said support structure and extending transverse to the upper surface of the ski;

a pivoting part having a first end, a second end, and a mid-portion disposed between said first and second ends, said first end including a pivot pin disposed thereon, said second end having at least one locking pin extending therefrom, and said mid-portion being pivotably connected to said horizontal transverse pin;

an elastic element disposed on said support structure for contacting said pivoting part to resist pivotal movement of said pivoting part about said transverse pin;

a boot retaining shell pivotably mounted about said transverse pin for movement between an opened position and a closed position and having a recess disposed therein, said locking pin for projecting through both said recess and the hook element of a ski boot when said retaining shell is in said closed position, and for releasing the hook element of the ski boot when said retaining shell is in said opened position;

a spring biasingly disposed between said pivoting part and said retaining shell for urging said retaining shell to said opened position; and a spring plunger pivotably mounted about said pivot pin of said pivoting part for locking said retaining shell in said closed position.

2. A ski binding for attachment to a ski and for retaining a ski boot having a hook element extending therefrom, the ski binding comprising:

a support structure for disposition on the upper surface of a ski;

a horizontal transverse pin attached to said support structure and extending transverse to the upper surface of the ski;

a pivoting part having a first end, a mid-portion, and a second end, said first end including a pivot pin disposed thereon, said mid-portion being pivotably connected to said horizontal transverse pin, and said second end having at least one locking pin extending therefrom and angled toward said horizontal transverse pin, said locking pin including a circular arc segment disposed therein for engaging the hook element of the ski boot;

an elastic element disposed on said support structure for contacting said pivoting part to resist pivotal movement of said pivoting part about said transverse pin;

a boot retaining shell pivotably mounted about said transverse pin for movement between an opened position and a closed position and having a recess disposed therein, said locking pin for projecting through both said recess and the hook element of the ski boot when said retaining shell is in said closed position, and for releasing the hook element of the ski boot when said retaining shell is in said opened position, said retaining shell further including a crossbar extending therefrom, said crossbar having a latch groove disposed therein;

a spring biasingly disposed between said pivoting part and said retaining shell for urging said retaining shell to said opened position; and a spring plunger pivotably mounted about said pivot pin of said pivoting part and having a portion for engaging said latching groove of said crossbar to lock said retaining shell in said closed position.

3. A ski binding as set forth in claim 2 wherein said boot retaining shell further includes opposing side walls having bearing surfaces angled toward each other, and said locking pin of said pivoting part includes a linear segment extending from said circular arc segment to a distal end thereof.

4. A ski binding for attachment to the upper surface of a ski having a central axis, the ski binding comprising:

a support structure for disposition on the upper surface of a ski;

a horizontal transverse pin attached to said support structure and extending transverse to the upper surface of the ski;

a ski boot having a hook element extending therefrom;

a pivoting part having a first end, a mid-portion, and a second end, said first end including a pivot pin disposed thereon, said mid-portion being pivotably connected to said horizontal transverse pin, and said second end having at least one locking pin extending therefrom and angled toward said horizontal transverse pin, said locking pin including a circular arc segment disposed therein for engaging the hook element of the ski boot and a linear segment comprising said circular arc segment with a distal end of said locking pin;

an elastic element disposed on said support structure for contacting said pivoting part to resist pivotal movement of said pivoting part about said transverse pin;

a retaining shell for retaining a portion of said ski boot therein, said retaining shell being pivotably mounted about said transverse pin for movement between an opened position and a closed position and having a recess disposed therein, said locking pin for projecting through both said recess and the hook element of the ski boot when said retaining shell is in said closed position, and for releasing the hook element of the ski boot when said retaining shell is in said opened position, said retaining shell further including opposing side walls having bearing surfaces angled toward each other and further including a crossbar extending therefrom, said crossbar having a latch groove disposed therein;

a spring biasingly disposed between said pivoting part and said retaining shell for urging said retaining shell to said opened position; and a spring plunger pivotably mounted about said pivot pin of said pivoting part and having a portion for engaging said latching groove of said crossbar to lock said retaining shell in said closed position.

5. A ski binding according to claim 4 wherein said bearing surfaces are each angled at approximately 45° with respect to the central axis of the ski.

6. A ski binding according to claim 3 wherein the ski boot includes a lateral front area having converging support surfaces and guide surfaces, the hook element extending from the lateral front area of the boot and having a U-shape and a cylindrical cross-section for engagement with the circular arc segment of the locking pin.

7. A ski binding according to claim 6 wherein the U-shaped hook element includes opposing legs and a mid-portion extending between and connecting the opposing legs, and wherein the lateral front area of the boot includes sole material extending therefrom, said legs being embedded in said sole material, and said sole material being bevelled at angles of approximately 45° proximate locations where said opposing legs of said hook element are connected to the mid-portion of the hook element.

8. A ski binding according to claim 6 wherein the boot retaining shell further includes a bottom surface for supporting the guide surfaces of the ski boot and wherein the support surfaces of the ski boot are parallel to the bearing surfaces of the retaining shell when the ski boot is disposed therein.

9. A ski binding according to claim 8 wherein the pivot part further includes a bottom surface portion that extends in a direction away from the surface of the ski, and the bottom surface of the retaining shell includes openings disposed therein, said openings being located at positions between said transverse pin and the lateral front surface of the boot when the boot is disposed in the boot retaining shell.

10. A ski binding according to claim 4 wherein the hook element moves along the linear segment of the locking pin and becomes seated in the circular arc segment in response to a downward force toward the ski exerted through a ski boot disposed in the retaining shell.

11. A ski binding for attachment to a ski and for retaining a ski boot having a hook element extending therefrom, the ski binding comprising:

a support structure for disposition on the upper surface of a ski;

a horizontal transverse pin attached to said support structure;

a pivoting part having a first end, a second end, and a mid-portion disposed between said first and second ends, said first end including a pivot pin disposed thereon, said second end having at least one locking pin extending therefrom, and said mid-portion being pivotably connected to said horizontal transverse pin;

an elastic element disposed on said support structure for contacting said pivoting part to resist pivotal movement of said pivoting part about said transverse pin;

a boot retaining shell pivotably mounted about said transverse pin for movement between an opened position and a closed position and having a recess disposed therein, said locking pin for projecting through both said recess and the hook element of the ski boot when said retaining shell is in said closed position, and for releasing the hook element of the ski boot when said retaining shell is in said opened position, said retaining shell further including a crossbar extending therefrom, said crossbar having a latch groove disposed therein and an elevated area disposed adjacent said latch groove;

a spring biasingly disposed between said pivoting part and said retaining shell for urging said retaining shell to said opened position; and a spring plunger pivotably mounted about said pivot pin of said pivoting part and having a locking end, said elevated area of said retaining shell and said latch groove cooperating to retain the locking end in said latch groove to thereby lock the retaining shell in said closed position, said spring plunger being selectively pivotable to release said locking end from the retained position.

12. A ski binding for attachment to a ski and for retaining a ski boot having a hook element extending therefrom, the ski binding comprising:

a support structure for disposition on the upper surface of a ski;

a horizontal transverse pin attached to said support structure;

a pivoting part having a first end, a second end, and a mid-portion disposed between said first and second ends, said first end including a pivot pin disposed thereon, said second end having at least one locking pin extending therefrom, and said mid-portion being pivotably connected to said horizontal transverse pin;

an elastic element disposed on said support structure for contacting said pivoting part to resist pivotal movement of said pivoting part about said transverse pin;

a boot retaining shell pivotably mounted about said transverse pin for movement between an opened position and a closed position and having a recess disposed therein, said locking pin for projecting through both said recess and the hook element of the ski boot when said retaining shell is in said closed position, and for releasing the hook element of the ski boot when said retaining shell is in said opened position, said retaining shell further including a crossbar extending therefrom, said crossbar having a latch groove disposed therein;

a spring biasingly disposed between said pivoting part and said retaining shell for urging said retaining shell to said opened position; and a spring plunger pivotably mounted about said pivot pin of said pivoting part and having a portion for engaging said latching groove of said crossbar to lock said retaining shell in said closed position, said spring plunger being radially displaced by a first angle $\alpha$ when said retaining shell is moved from said opened position to said closed position, and said spring plunger being radially displaced by a second angle $\beta$ when said retaining shell is moved from said closed position to said opened position, said first angle being substantially equal to or greater than said second angle.

13. A ski binding according to claim 12 wherein the plunger is disposed at substantially the same radial position relative to said pivot pin when said retaining shell is in said opened position and when said retaining shell is in said closed position.

14. A ski binding according to claim 12 wherein said crossbar of said retaining shell includes an elevated area disposed proximate said latch groove and said spring plunger includes a stop for engaging said elevated area when said retaining shell is in said opened position.

* * * * *